US007020937B2

(12) United States Patent
Nakatsuka et al.

(10) Patent No.: US 7,020,937 B2
(45) Date of Patent: Apr. 4, 2006

(54) PULL TAB FOR A SLIDE FASTENER

(75) Inventors: Yoshiki Nakatsuka, Osaka (JP); Kiyotaka Itatani, Osaka (JP)

(73) Assignee: Morito Co., Ltd., Osaka (JP)

( * ) Notice: Subject to any disclaimer, the term of this patent is extended or adjusted under 35 U.S.C. 154(b) by 0 days.

(21) Appl. No.: 10/864,476

(22) Filed: Jun. 10, 2004

(65) Prior Publication Data

US 2005/0005407 A1 Jan. 13, 2005

(30) Foreign Application Priority Data

Jul. 7, 2003 (JP) ..... 2003-271258
Oct. 31, 2003 (JP) ..... 2003-373240

(51) Int. Cl.
*A44B 19/26* (2006.01)

(52) U.S. Cl. ..... 24/429

(58) Field of Classification Search ..... 24/429–431; D11/221

See application file for complete search history.

(56) References Cited

U.S. PATENT DOCUMENTS 5,031,420 A * 7/1991 Song ..... 63/21
6,314,625 B1 * 11/2001 Ikeda ..... 24/429
2002/0069494 A1 * 6/2002 McCrum ..... 24/429
2003/0033697 A1 * 2/2003 Hicks et al. ..... 24/615
2003/0079317 A1 * 5/2003 Oda et al. ..... 24/429

FOREIGN PATENT DOCUMENTS

| | | | |
|---|---|---|---|
| EP | 1512338 A1 * | 3/2005 | |
| JP | 3027783 | 5/1996 | |
| JP | 10137009 | 5/1998 | |
| JP | 2000014412 A * | 1/2000 | |
| JP | 2000079005 A * | 3/2000 | |
| JP | 2000225007 | 8/2002 | |
| WO | WO 8002494 A * | 11/1980 | |

* cited by examiner

*Primary Examiner*—James R. Brittain
(74) *Attorney, Agent, or Firm*—Bacon & Thomas PLLC

(57) ABSTRACT

A pull tab for a slide fastener comprising a slide-connector, an intermediate part, and a grip. The slide-connector has a slide-connecting head and two extending legs provided individually with widened retain at their distal ends. The intermediate part has, at its front end, two holes formed through it to receive individually the extending legs of the slide-connector, and at its rear end, two notched portions and a hook. The grip has a body portion and an outwardly protruded engaging portion. The retainers are adapted to seat on the notched portions to achieve locking, while blocking the aperture of the hook.

2 Claims, 4 Drawing Sheets

PULL TAB FOR A SLIDE FASTENER

FIELD OF THE INVENTION

The present invention relates to a pull tab for opening and closing a slide fastener (or zipper), and in particular to a replaceable or interchangeable pull tab for a slide fastener.

BACKGROUND OF THE INVENTION

Although slide fasteners attached to clothes, bags, etc. are normally equipped in advance with a pull tab for opening and closing a slide fastener, there exists a strong demand among consumers for replacing them with others for various reasons. For example, (1) original pull tabs are too small to be gripped, (2) original pull tabs are out of date or of unsatisfactory designs, or (3) original pull tabs are out of accord with clothes to be worn. On such occasions, it would be convenient if consumers can change the pull tabs in a practical, simplified manner.

Such replaceable pull tabs for slide fasteners have been disclosed, for example, in JP-A-10-137009 (1988), JP-A-2000-225007 and JP-U-3027783.

JP-A-10-137009 discloses a replaceable slide fastener pull tab which consists of an intermediate part, a pull tab and a slide-connector, wherein the intermediate part and the pull tab are connected by inserting the pull tab into an insertion hole provided inside the intermediate part and combined by machine-sewing.

JP-A-2000-225007 describes a replaceable slide fastener pull tab which consists of a slide-connector, intermediate part and a grip, wherein the slide-connector and intermediate part constitute a complex interlock-release mechanical arrangement.

JP-U-3027783 discloses a replaceable pull tab which consists of a slide-connector, intermediate part and a grip, wherein the intermediate part and grip are connected and fixed by machine-sewing, etc.

The replaceable pull tabs for slide fasteners described in JP-A-10-137009 and JP-U-3027783, which are connected by machine-sewing between the intermediate part and the grip, suffer from the disadvantage that replacement at the connecting part is difficult to be achieved. In JP-U-3027783, the connecting mechanism is not clear in the specification but judging from the drawings, the grip appears to be folded into two portions and pressed against a pin of the intermediate part and the folded pull tab pieces are combined by machine-sewing, etc. If so, this technique also has difficulties in achieving replacement at this part. In such prior art disclosures, the intermediate part and grip are designed to be replaced together as an integral unit, but naturally it would be economical if the grip alone can be replaced.

In addition, the replaceable slide fastener pull tab disclosed in JP-A-2000-225007 has a drawback in that the pull tab is composed of a lot of components. In the case of JP-A-10-137009 and JP-U-3027783, the pull tabs contain two or three components and therefore do not present any problem in this respect, but they suffer from the disadvantage that they act rigidly against the slide fastener slide as described hereinafter.

OBJECT AND SUMMARY OF THE INVENTION

The major object of the present invention is to provide a pull tab for a slide fastener that consists of few components, facilitates exchange and replacement among the components and provides a flexible movement.

The pull tab for a slide fastener according to the present invention comprises three components, a slide-connector, an intermediate part and a grip, wherein said three components are replaceable by connecting and disconnecting among them by way of insertion and extraction.

As explained above, some of the prior-art slide fastener pull tabs also consist of three components, a slide-connector, an intermediate part and a grip, but they fail to be replaced with the others, because the intermediate part and the grips are firmly fixed by machine-sewing, etc. In contrast, the pull tab for a slide fastener according to the present invention can allow the components to be connected and disconnected simply by way of insertion and extraction among them and is therefore easy to achieve such component replacement. This also facilitates easy replacement of the grips alone so as to be matched with clothes.

The pull tab for a slide fastener according to the present invention, when in use, is illustrated in FIGS. 3 and 4. The pull tab is bendable at two locations between the slide-connector 10 and the intermediate part 20, and is consequently improved in flexibility. This is in sharp contrast with the prior-art counterparts as explained above, which are bendable at only one location in the slide-connector.

In the present invention, the slide-connector may consist of a slide-connecting head and two extending legs stretching therefrom. The slide-connecting head may be formed as a partly notched ring, semi-circle, D-letter, square or polygon. Each extending leg may desirably be provided at the distal end with a widened retainer.

It is particularly preferable that the slide-connector is formed with a stamped metal sheet, with a twisting being made between the head and the extending legs. This renders the slide-connecting head raised in the plane nearly vertical to the flat extending legs.

Preferably, the intermediate part has two holes formed therethrough to receive individually the extending legs of the slide-connector at its front end, and has notched portions and a central hook portion formed at its rear end.

It is preferable that the grip has a body portion and an outwardly protruded engaging portion. As such engaging portion, use can be made, for example, of a portion having two arms and a pin connecting with the arms, or C-shaped protruded portions.

A connection between the intermediate part and the grip may be a combination of the hook and pin. It is preferable that when the intermediate part is connected to the grip, the retainers are arranged to block the aperture of the hook.

BRIEF DESCRIPTION OF THE DRAWINGS

The present invention will now be described below with reference to the accompanying drawings, in which.

DETAILED DESCRIPTION OF PREFERRED EMBODIMENTS

EXAMPLE 1

Figure 1:
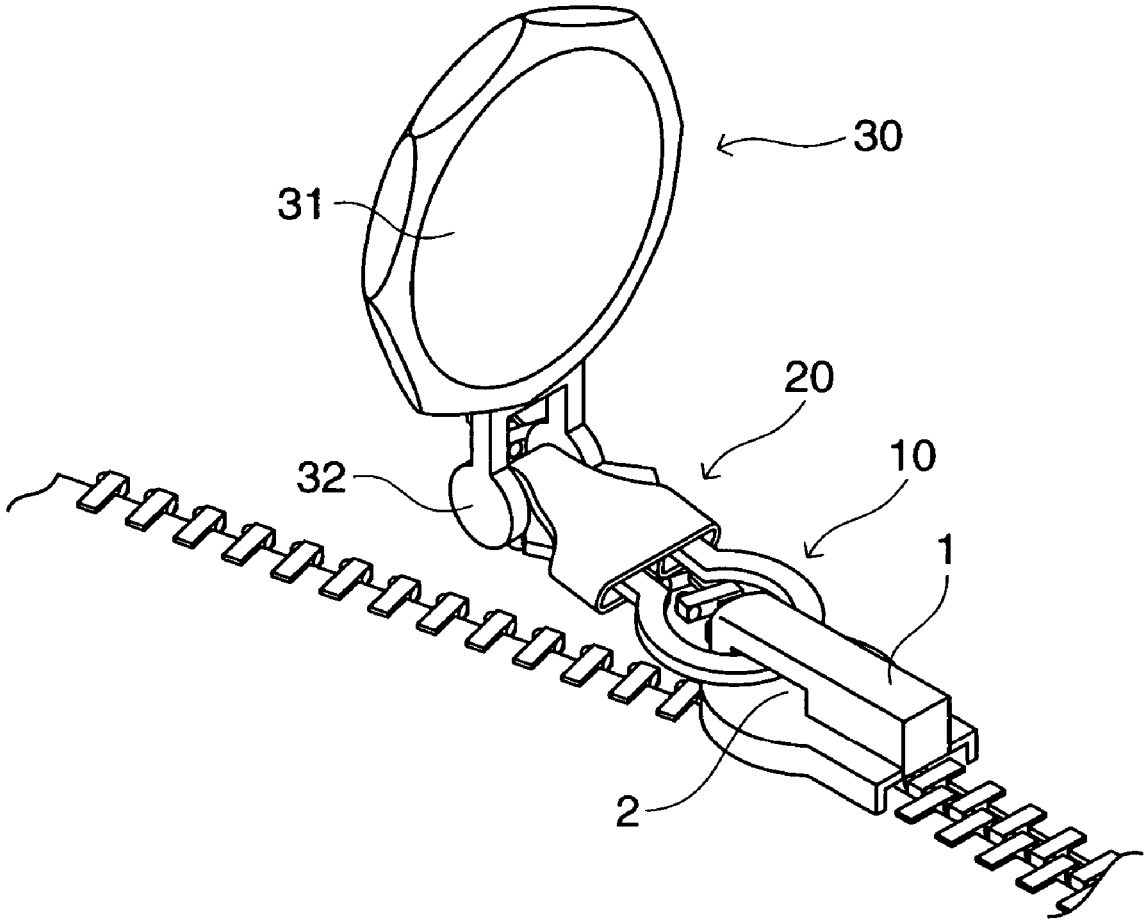
FIG. 1 is a perspective view of a pull tab for a slide fastener according to an embodiment of the present invention according to Example 1.
Figure 2:
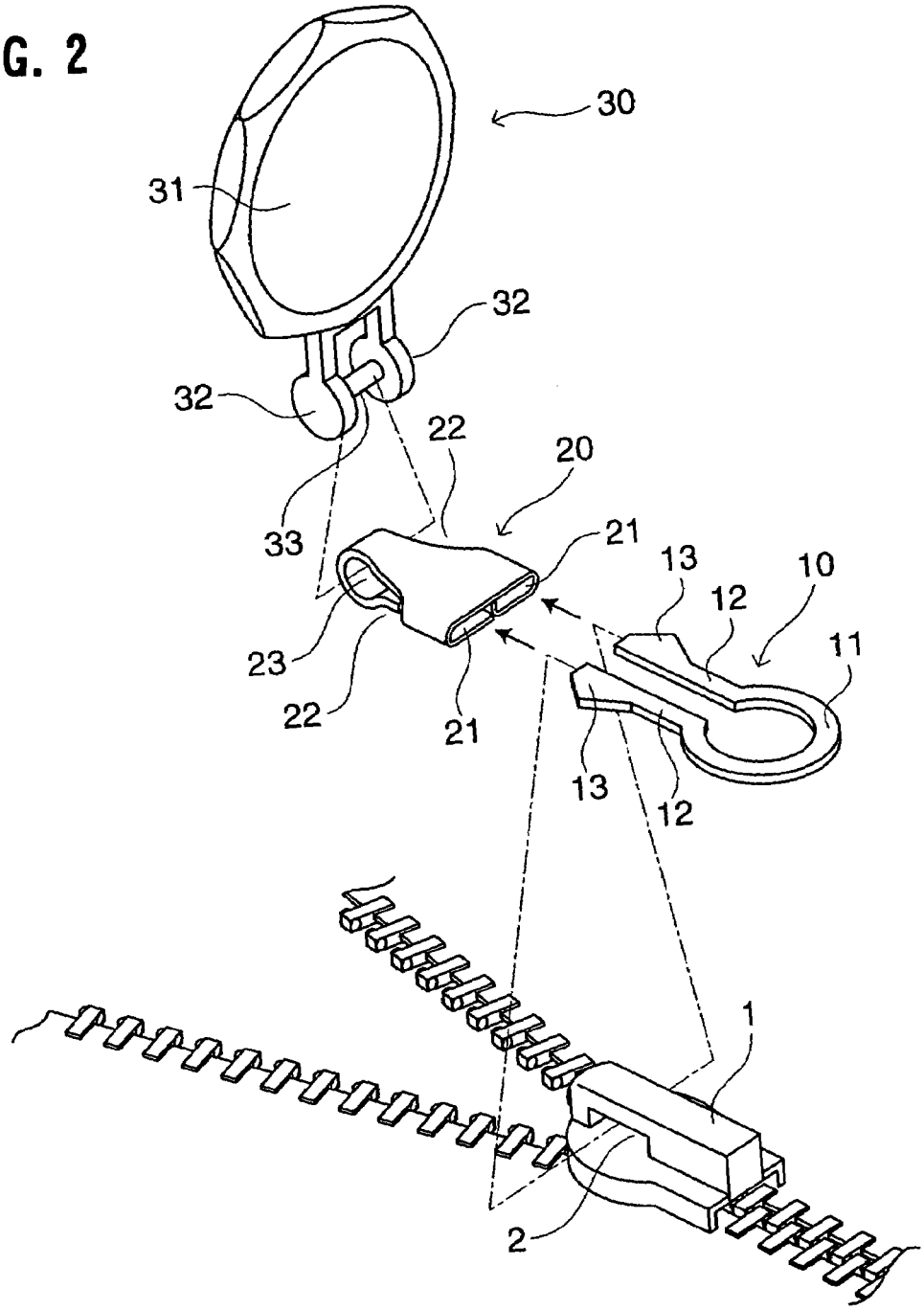
FIG. 2 is a disassembled perspective view of FIG. 1.

FIG. 1 is a perspective view of a pull tab for a slide fastener according to an embodiment of the present invention according to Example 1 and FIG. 2 is a disassembled perspective view of FIG. 1.

As is obvious from the drawings, the pull tab for a slide fastener consists of three components: a slide-connector 10, an intermediate part 20 and a grip 30.

As is shown in FIG. 2, the slide-connector 10 has a partly notched ring 11 for engaging a slide fastener slide 1 and two extending legs 12 stretching individually from the partly notched ring ends. Each of the legs 12 is provided at their distal ends with a progressively widened retainer 13. The two legs 12, with their spring resilience, can be inserted in a hole 2 of a slide fastener slide (see FIG. 1) to thereby be integrated into one-piece.

Figure 3:
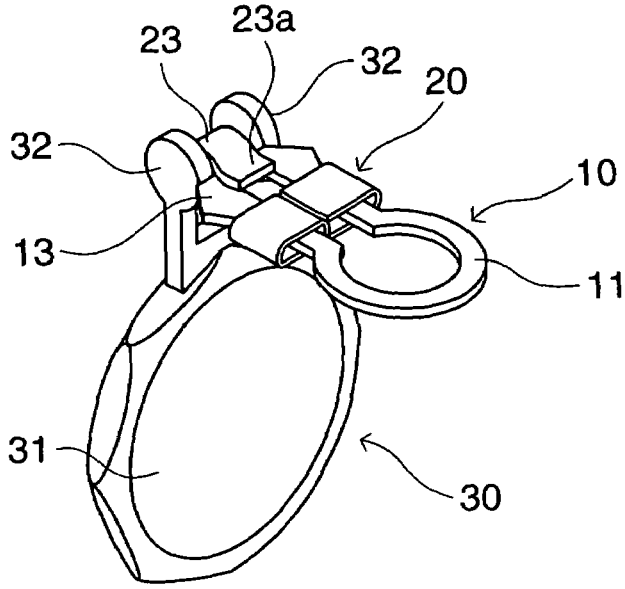
FIG. 3 is a perspective view of the connecting condition between the intermediate part and the grip.
Figure 4:
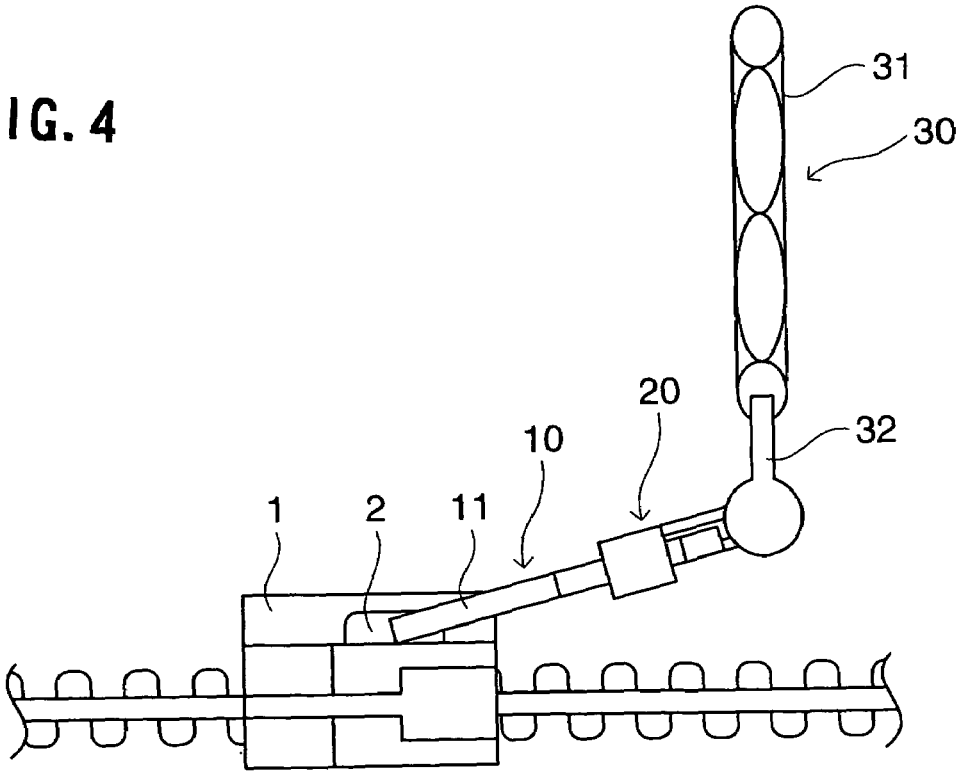
FIG. 4 is a side view of the pull tab for a slide fastener during use.

The intermediate part 20 is made by bending one metal plate, with its face side being shown in FIGS. 1 and 2 and rear side in FIG. 3, respectively. It has two holes 21 formed therethrough on the side of its front end to receive the extending legs 12, and two right and left notched portions 22 and a central hook 23 formed on the side of its rear end. When the slide-connector 10 is connected to the intermediate part 20 by allowing the retainers 13 of the legs to seat on the notched portions 22, both of the members 10, 20 are locked in place (see FIG. 1).

The grip 30 consists of a body portion 31, two arms 32 being protruded therefrom and a pin 33 connecting with the two arms 32. The body portion 31 is formed into a polygon disk in Example 1, but may be formed and designed in any shapes, as long as fingers can grip it. As shown in FIGS. 1 and 2, the hook 23 is hooked over the pin 33 to thereby connect the intermediate part 20 to the grip 30. As shown in FIG. 3, the aperture of the hook 23*a* is blocked by the retainer 13 in the connected condition to thereby secure interconnection among the slide-connector 10, intermediate part 20 and grip 30.

The pull tab for a slide fastener according to the present invention, when in use, is bendable and flexible at two locations between the slide-connector 10 and intermediate part 20.

To assemble the above-mentioned three components and fit the pull tab into a slide fastener slide, the following steps are usually required.

(1) To prepare an assembled pull tab consisting of a slide-connector 10, an intermediate part 20 and a grip 30. Manufacturers will put the pull tabs on the market in this assembled form.

(2) An originally equipped pull tubs (not illustrated) is removed from a slide fastener, for example, by cutting with a cutter, thus exposing a connecting hole 2 at the same place.

(3) The slide-connector 10 is disconnected from the intermediate part 20.

(4) The partly notched ring 11 of the slide-connector 10 is connected to the mounting hole 2 of the slide 1 by passing one of the extending legs 12 through the connecting hole 2.

(5) The extending legs 12 of the slide-connector 10 are inserted into the holes 21 on the intermediate part 20. The spring resilience in the legs is restored to thereby allow the retainers 13 to seat on the notched portions 22 of the intermediate part 20.

In cases where only the grip 30 is replaced with an alternative one in the above-described assembled pull tab, the following steps are taken.

(6) The slide-connector 10 is disconnected from the intermediate part 20, whereby the retainer 13 of the slide-connector also is detached from the intermediate part 20, leaving the aperture 23*a* of the hook 23 open again.

(7) The intermediate part 20 is disconnected from the grip 30 by disengaging the pin 33 of the grip 30 from the aperture 23*a* of the hook 23.

(8) A new grip 30 is mounted to the intermediate part 20 in a reverse way to the steps described in (7).

(9) The intermediate part 20 is connected to the slide-connector 10 by the same steps as mentioned in (4) and (5).

EXAMPLE 2

Figure 5:
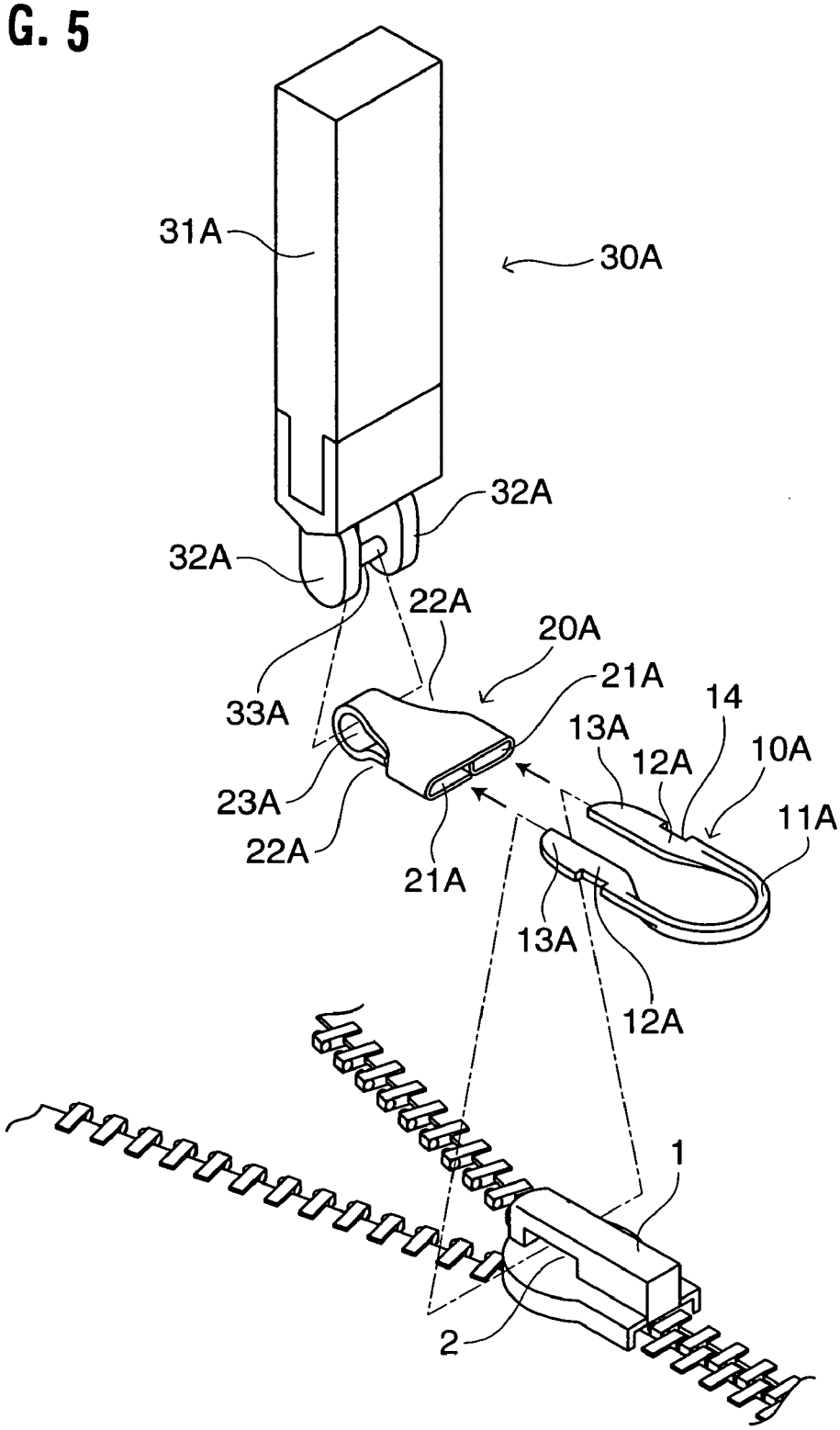
FIG. 5 is a disassembled perspective view of a pull tab for a slide fastener according to an embodiment of the present invention according to Example 2.

FIG. 5 is an exploded perspective view of a pull tab for a slide fastener according to an embodiment of the present invention in Example 2. Hereinafter, Example 2 is discriminated from Example 1 by adding the letter "A" to the numerals of Example 1 for the same or similar components.

The pull tab of Example 2 contains the grip 30A and slide-connector 10A that are different in shape from the ones of Example 1 in FIG. 2. The shape of the grip 30A is a mere alteration of design and is therefore not essential to the present invention.

The characteristic feature of Example 2 lies in the particular shape of the slide-connector 10A. The slide-connector 10A is preferably made by a stamped metal sheet material and consists of a partly notched ring 11A and extending legs 12A stretching from both ends thereof. The extending legs 12A are provided with two outwardly facing notches 14, with the result that individual expanding retainers 13A are formed at their distal ends. The retainers 13A are protrusions taking the form of one of a four equally divided oval body portion.

Example 2 differs from Example 1 in that twisting is added between the ring 11A and inserting leg 12A, thus making material in the area of the ring 11A raised in the plane nearly vertical (perpendicular) to the material in the area of the insertion leg 12A.

Use of the construction of Example 2 can provide the slide-connector 10A with increased mechanical strength and spring resilience. In addition, it can permit the retainer 13A (Example 2) having notches 14 to produce an enhanced retaining effect, as compared with the triangular-shaped retainer 13 (Example 1). As a result, the embodiment of Example 2 can yield an increased binding force between the slide-connector 10A and the intermediate part 20A. Furthermore, the nearly vertical-raised loop-shaped top end 11A enables the pull tab to take increased degree of freedom in movement within the connecting hole 2 and is more flexible.

The invention claimed is:

1. A pull tab for a slide fastener, comprising:

a slide-connector having a slide-connecting head and two extending legs provided individually with widened retainers at their distal ends;

an intermediate part having, at its front end, two holes formed therethrough to receive individually the extending legs of the slide-connector, and at its rear end, two notched portions and a hook having an aperture; and a grip having a body portion and an outwardly protruded engaging portion, the engaging portion being adapted for engagement with said hook to connect the grip to the intermediate part;

wherein said retainers are adapted to seat on the notched portions to thereby achieve locking, while blocking the aperture of the hook; and whereby said three components are replaceable by connecting and disconnecting among them by way of insertion and extraction.

2. A pull tab as claimed in claim 1, wherein the slide-connector is formed from a flat sheet material and has a twisted portion between the slide-connecting head and the extending legs to thereby make the material in the slide-connecting head nearly perpendicular to the material in the extending legs.

* * * * *